US010026573B2

(12) United States Patent
Yoo et al.

(10) Patent No.: US 10,026,573 B2
(45) Date of Patent: Jul. 17, 2018

(54) TRIPPING DEVICE OF CIRCUIT BREAKER

(71) Applicant: LSIS CO., LTD., Anyang-si, Gyeonggi-do (KR)

(72) Inventors: Sung Rok Yoo, Cheongju-si (KR); Jong Mahn Sohn, Cheongju-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 382 days.

(21) Appl. No.: 14/921,804

(22) Filed: Oct. 23, 2015

(65) Prior Publication Data

US 2016/0126041 A1 May 5, 2016

(30) Foreign Application Priority Data

Oct. 31, 2014 (KR) ..... 10-2014-0150535

(51) Int. Cl.

| | |
|---|---|
| ***H01H 47/22*** | (2006.01) |
| ***H01H 50/18*** | (2006.01) |
| ***H01H 50/36*** | (2006.01) |
| ***H01H 71/02*** | (2006.01) |
| ***H01H 71/24*** | (2006.01) |
| ***H01H 71/32*** | (2006.01) |
| ***H01H 73/40*** | (2006.01) |

(52) U.S. Cl.

CPC ..... *H01H 47/22* (2013.01); *H01H 50/18* (2013.01); *H01H 50/36* (2013.01); *H01H 71/0207* (2013.01); *H01H 71/2463* (2013.01); *H01H 71/325* (2013.01); *H01H 73/40* (2013.01)

(58) Field of Classification Search

CPC ..... H01H 47/22; H01H 50/18; H01H 50/36; H01H 71/0207; H01H 71/2463; H01H 71/325; H01H 73/40

See application file for complete search history.

(56) References Cited

U.S. PATENT DOCUMENTS 6,218,921 B1 * 4/2001 Eberts ..... H01H 71/322 335/172
9,368,294 B2 * 6/2016 Ohtsuka ..... H01F 7/124
(Continued)

FOREIGN PATENT DOCUMENTS

| | | |
|---|---|---|
| JP | 2722759 | 3/1998 |
| KR | 10-2011-0106198 | 9/2011 |
| KR | 101317224 | 10/2013 |

OTHER PUBLICATIONS

Korean Intellectual Property Office Application Serial No. 10-2014-0150535, Notice of Allowance dated Oct. 5, 2016, 5 pages.

(Continued)

*Primary Examiner* — Scott Bauer
(74) *Attorney, Agent, or Firm* — K&L Gates LLP

(57) ABSTRACT

A tripping device of a circuit breaker of the present disclosure may reinforce a magnetic force on a main magnetic flux path using a plurality of magnetic force reinforcing plates without using an additional plate yoke on an actuator provided in the circuit breaker to miniaturize the size of the actuator, thereby having an effect of allowing a control circuit unit provided at an outer portion of the circuit breaker to be installed at an inner portion of the circuit breaker to miniaturize the whole size of the circuit breaker.

5 Claims, 14 Drawing Sheets

(56) References Cited

U.S. PATENT DOCUMENTS

2006/0208841 A1* 9/2006 Morita ..... H01F 7/1615
335/220
2012/0112860 A1* 5/2012 Gruden ..... H01F 7/122
335/229

OTHER PUBLICATIONS

Korean Intellectual Property Office Application Serial No. 10-2014-0150535, Office Action dated Nov. 16, 2015, 4 pages.

* cited by examiner

TRIPPING DEVICE OF CIRCUIT BREAKER

CROSS-REFERENCE TO RELATED APPLICATIONS

Pursuant to 35 U.S.C. § 119(a), this application claims the benefit of earlier filing date and right of priority to Korean Patent Application No. 10-2014-0150535, filed on Oct. 31, 2014, the contents of which are all hereby incorporated by reference herein in its entirety.

BACKGROUND OF THE INVENTION

1. Field of the Invention

The present invention relates to a tripping device of a circuit breaker, and more particularly, to a tripping device of a circuit breaker for miniaturizing the tripping device to simplify the structure of the circuit breaker as well as increasing the number of circuit breakers used for a distribution board to efficiently implement the control of power through the distribution board.

2. Description of the Related Art

In general, a circuit breaker is an electrical protection device installed between a power source and a load device to protect the load device and a line from a fault current (a high current due to short-circuit, ground fault, etc.) that can occur in an electrical circuit.

The circuit breaker is provided with a stationary contact point and a movable contact point to connect and release between a busbar and a load, and provided with a tripping device configured to control the movable contact point to be quickly separated from the stationary contact point when a fault current occurs.

FIG. 1 is a perspective view illustrating a circuit breaker in the related art, and FIG. 2 is a plan view illustrating a circuit breaker in the related art, and FIG. 3 is a schematic diagram illustrating a configuration in which a tripping device and a control circuit provided in a circuit breaker in the related art are connected to each other, and FIG. 4 is a perspective view illustrating a tripping device provided in a circuit breaker in the related art.

As illustrated in FIGS. 1 through 4, a circuit breaker in the related art is provided with a tripping device 12 at an inner portion of a case 10*a* constituting an external appearance of the circuit breaker 10, and provided with a control circuit unit 11 configured to control the tripping device 12, and the tripping device 12 receives control power from the control circuit unit 11 to control a tripping operation so as to connect and release between a busbar and a load.

Here, the tripping device 12 may include a housing 12*a* into which each constituent element is accommodated, an actuator 12*b* coupled to the housing 12*a* to generate a magnetic flux by an applied current, a cover 12*c* and a lever 12*d*, and the like.

On the other hand, FIG. 5 is an exploded perspective view illustrating an actuator provided in a tripping device of a circuit breaker in the related art, and FIG. 6 is a plan view illustrating a configuration in which a plurality of circuit breakers in the related art are connected on a distribution box.

As illustrated in FIGS. 5 and 6, the actuator 12*b* in the related art may include a yoke portion 12*b*-1 configured to form a main magnetic flux path, a cylinder 12*b*-2, a coil assembly 12*b*-3 wound with a coil in which a movable core and a stationary core are brought into contact with or separated from each other, a magnetic force reinforcing plate 12*b*-4 configured to reinforce a magnetic force, a gap plate 12*b*-6, a plate yoke 12*b*-7 configured to form an auxiliary magnetic flux path, and the like, and a plurality of actuators being connected with each other are used at an inner portion of a distribution board.

However, the actuator 12*b* of the circuit breaker 10 in the related art as described above may use an additional plate yoke 12*b*-7 to form an auxiliary magnetic flux path for reinforcing a magnetic force, and thus have a large volume, thereby causing a problem in which the control circuit unit 11 configured to supply control power to the actuator 12*b* cannot be installed at an inner portion of the tripping device 12 but should be installed at an outer portion of the case 10*a* of the circuit breaker 10.

Furthermore, since the control circuit unit 11 is installed at the outside, a space occupied by the circuit breakers 10 may be large, thereby causing a problem in which the number of circuit breakers that can be installed therein is greatly limited when installing the circuit breakers 10 at an inner portion of the distribution board.

Furthermore, the number of circuit breakers that can be installed in the distribution board may be limited, thereby causing a problem in which the use efficiency is greatly decreased.

SUMMARY OF THE INVENTION

The present invention is contrived to solve the foregoing problem, and an aspect of the present invention is to provide a tripping device of a circuit breaker for miniaturizing the tripping device to simplify the structure of the circuit breaker as well as increasing the number of circuit breakers used for a distribution board to efficiently implement the control of power through the distribution board.

The foregoing aspect of the present disclosure may be accomplished by providing a tripping device of a circuit breaker for receiving control power from a control circuit unit to allow a stationary contact point and a movable contact point to be brought into contact with or separated from each other to control power supply to a load, wherein the tripping device may include a housing formed with a mounting space to which an actuator is mounted and fixed at one side thereof, an actuator mounted and fixed to the mounting space, and configured with a yoke portion configured to receive control power from the control circuit unit to form a main magnetic flux path, a bobbin wound with a coil and attached to a permanent magnet, and a magnetic force reinforcing plate adhered to the bobbin to reinforce a magnetic force formed on the main magnetic flux path, and a first cover formed with a first support fixture inserted into the other side of the housing, and adhered to the magnetic force reinforcing plate at one side thereof to maintain a state that the magnetic force reinforcing plate is adhered to the bobbin.

Furthermore, the tripping device may further include a second cover formed with an opening portion configured to be open to insert the control circuit unit therein at the other side of the housing, and detachably adhered to the other side of the housing to close the opening portion to prevent the control circuit unit from being exposed to the outside.

Furthermore, a first support fixture engaging ring may be formed at one end of the first support fixture, and an engaging ring insertion groove may be formed at a position corresponding to the first support fixture engaging ring on the housing to adhere the first support fixture to the magnetic force control plate while at the same time the first support fixture engaging ring is inserted into the engaging ring insertion groove when the first cover is inserted into the other side of the housing.

Furthermore, a second support fixture supporting the actuator in a front direction of the actuator may be formed at the other side of the first cover, and a second support fixture engaging ring may be formed at an end of the second support fixture, and an adhesion plate may be formed on the housing to be adhered to a lower surface of the second support fixture, and an engaging groove may be formed at an upper portion of the adhesion plate, and when the first cover is inserted into the housing, the second support fixture engaging ring may be inserted into the engaging groove while at the same time a lower surface of the second support fixture is adhered to the adhesion plate.

Furthermore, a release prevention member located to be vertically spaced by a predetermined distance to prevent the permanent magnet from being released may be further formed adjacent to the mounting space of the housing.

Furthermore, the release prevention member may include a vertical plate formed in a vertical direction to support the permanent magnet on a lateral surface thereof, and a support plate extended in a horizontal direction from one end of the vertical plate to support the permanent magnet on an upper or lower portion thereof.

As described above, a tripping device of a circuit breaker of the present disclosure may reinforce a magnetic force on a main magnetic flux path using a plurality of magnetic force reinforcing plates without using an additional plate yoke on an actuator provided in the circuit breaker to miniaturize the size of the actuator, thereby having an effect of allowing a control circuit unit provided at an outer portion of the circuit breaker to be installed at an inner portion of the circuit breaker to miniaturize the whole size of the circuit breaker.

Furthermore, the whole size of a circuit breaker may be miniaturized to increase the number of the circuit breakers that can be installed on a distribution board, thereby having an effect of efficiently implementing the control of a current through the distribution board.

Furthermore, a first support fixture and a second support fixture may be installed on a first cover, thereby having an effect of securely supporting the actuator to an inner portion of the housing as well as preventing a magnetic force reinforcing plate provided on the actuator from being released from a fixed position.

Furthermore, a first support fixture engaging ring and a second support fixture engaging ring may be formed on a first support fixture and a second support fixture, thereby having an effect of securely coupling the first cover to the housing.

Furthermore, the number of magnetic force reinforcing plates may be controlled to increase a retaining force of the stationary core and movable core, and thus an elastic member capable of providing a larger restoring force may be used when the elastic member provides a restoring force in a direction opposite to the retaining force, thereby having an effect of quickly implementing the trip operation.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a tripping device of a circuit breaker according to an embodiment of the present disclosure will be described in detail with reference to the accompanying drawings.

Figure 1:
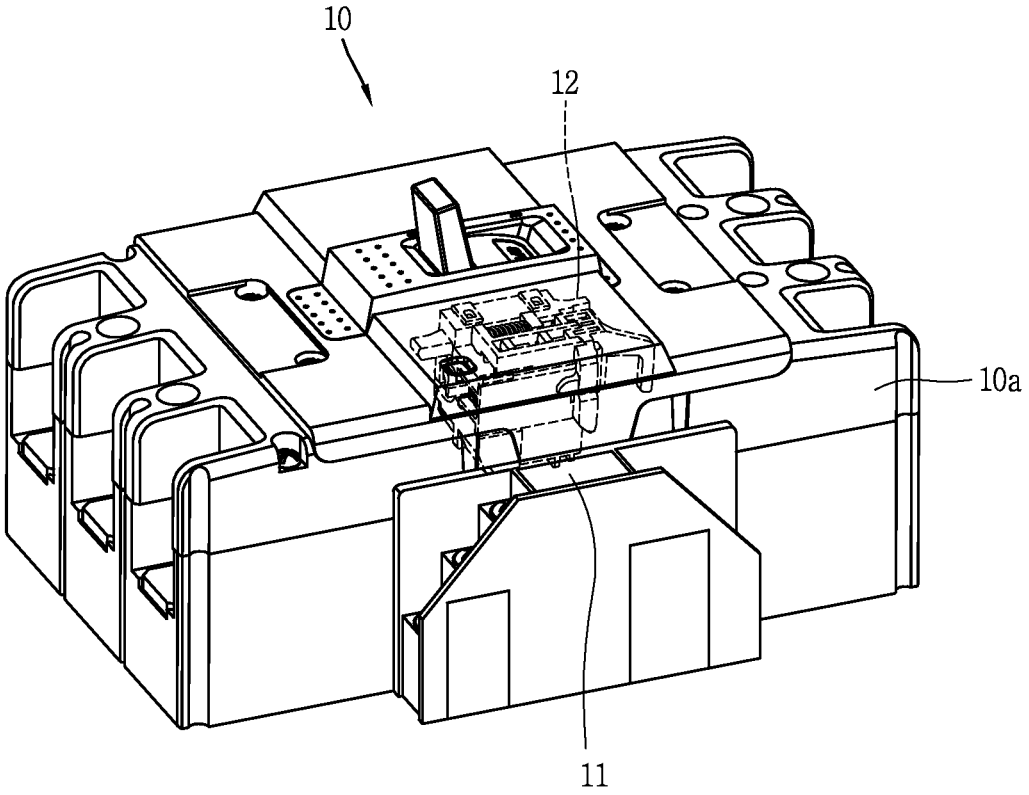
FIG. 1 RELATED ART
FIG. 1 is a perspective view illustrating a circuit breaker in the related art.
Figure 2:
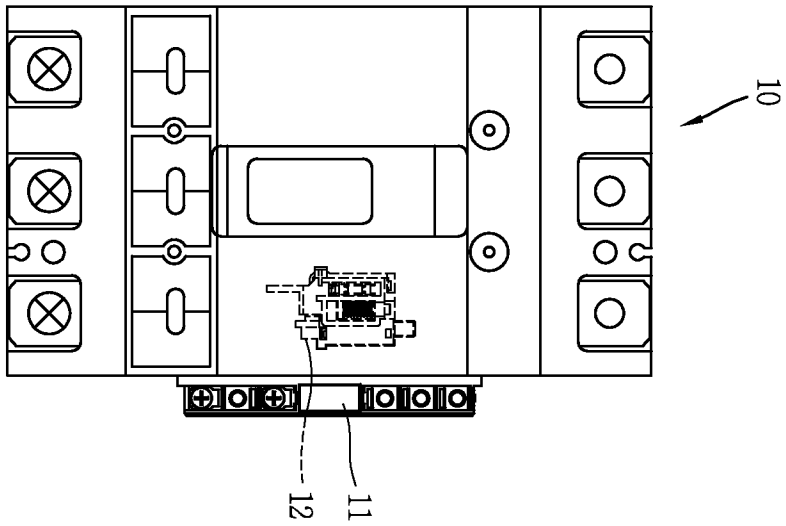
FIG. 2 RELATED ART
FIG. 2 is a plan view illustrating a circuit breaker in the related art.
Figure 3:
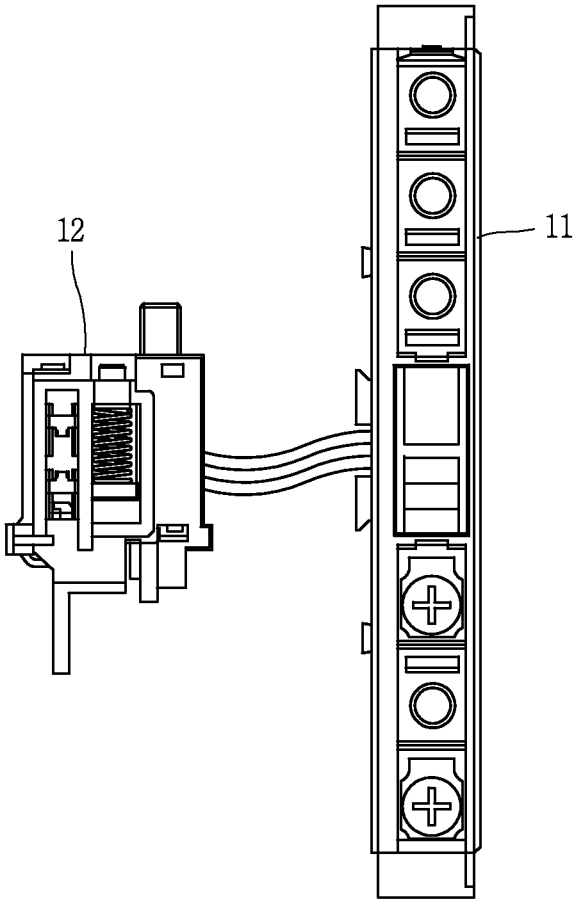
FIG. 3 RELATED ART
FIG. 3 is a schematic diagram illustrating a configuration in which a tripping device and a control circuit unit provided in a circuit breaker in the related art are connected to each other.
Figure 4:
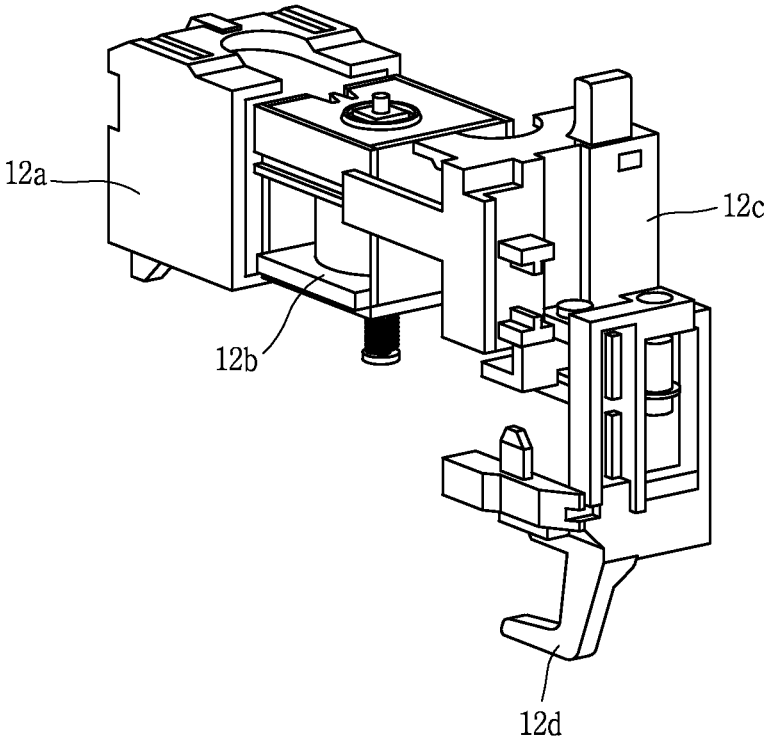
FIG. 4 RELATED ART
FIG. 4 is a perspective view illustrating a tripping device provided in a circuit breaker in the related art.
Figure 5:
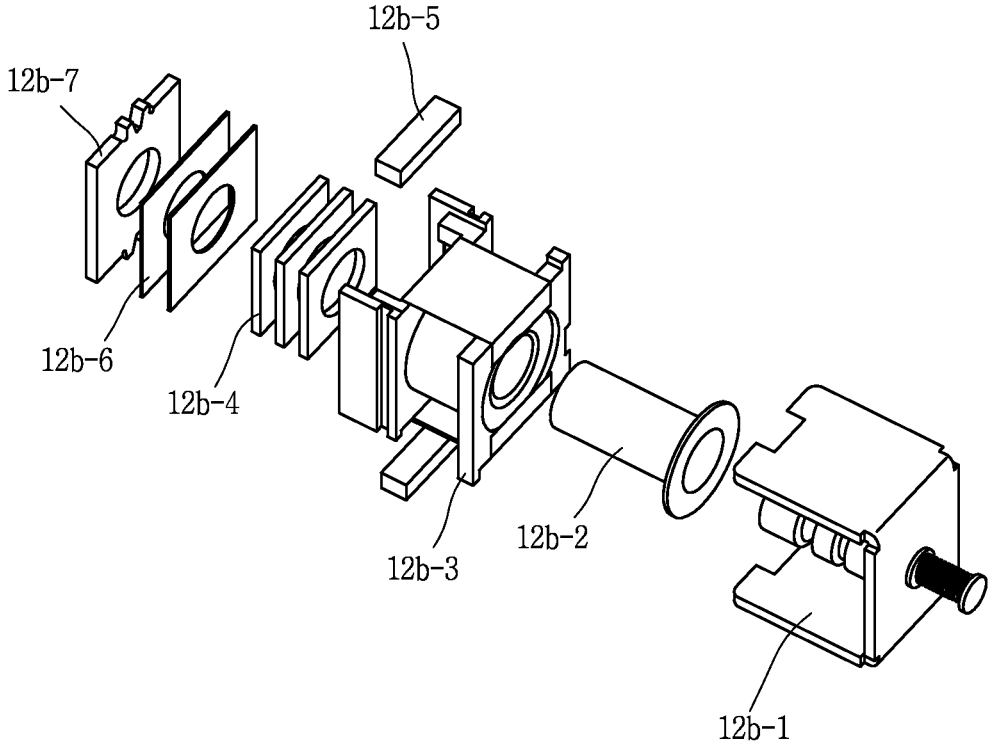
FIG. 5 RELATED ART
FIG. 5 is an exploded perspective view illustrating an actuator provided in a tripping device of a circuit breaker in the related art.
Figure 6:
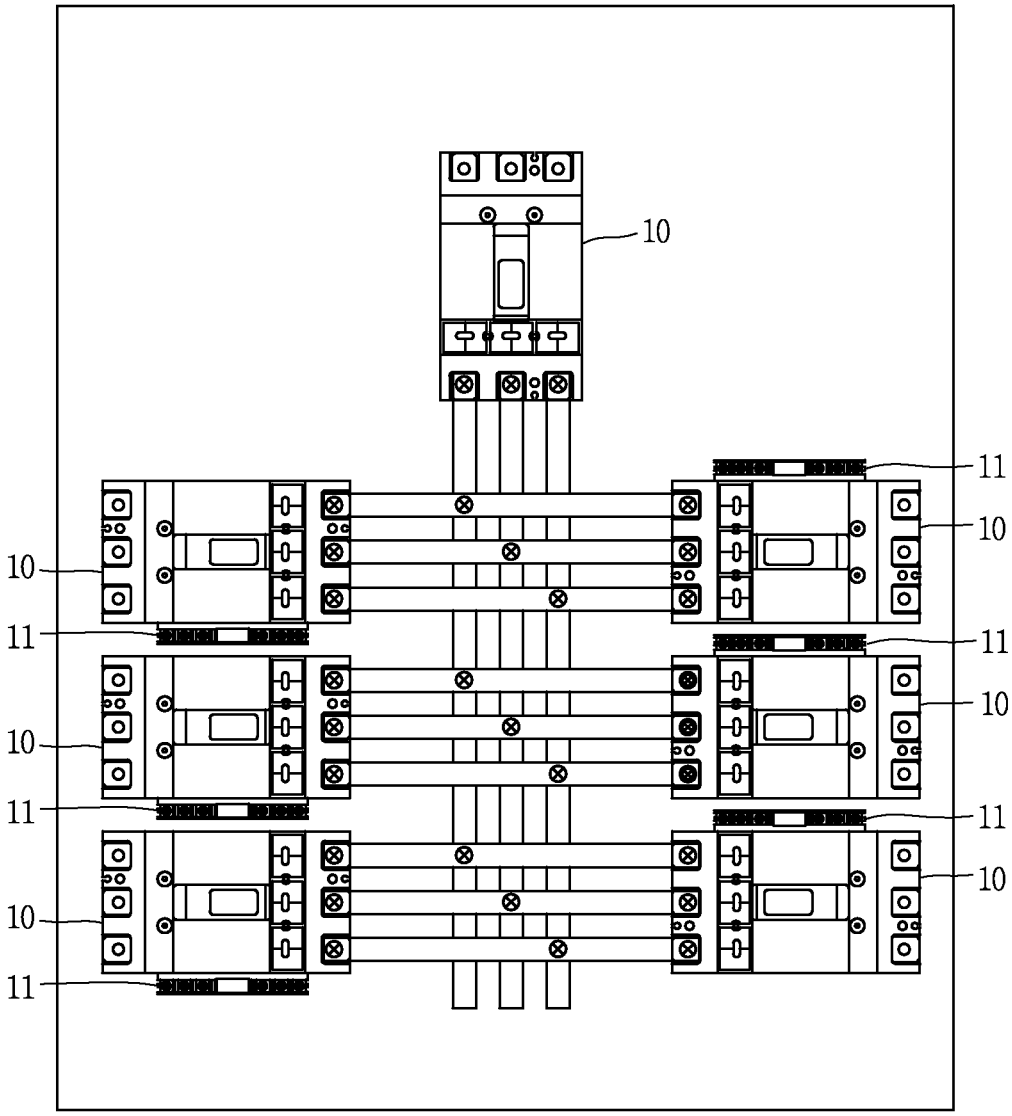
FIG. 6 RELATED ART
FIG. 6 is a plan view illustrating a configuration in which a plurality of circuit breakers in the related art are connected on a distribution board.
Figure 7:
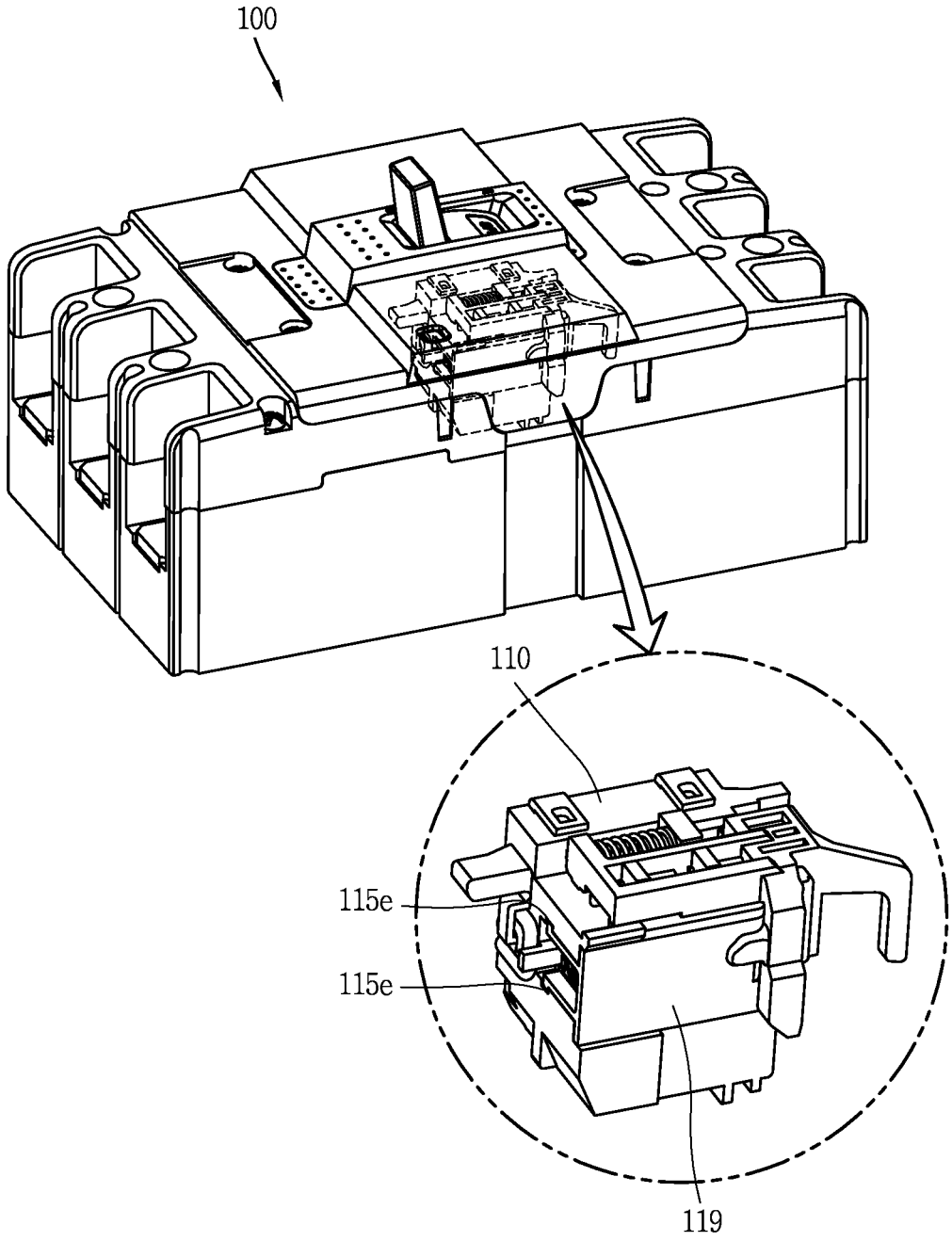
FIG. 7 is a perspective view illustrating a circuit breaker according to the present disclosure.
Figure 8:
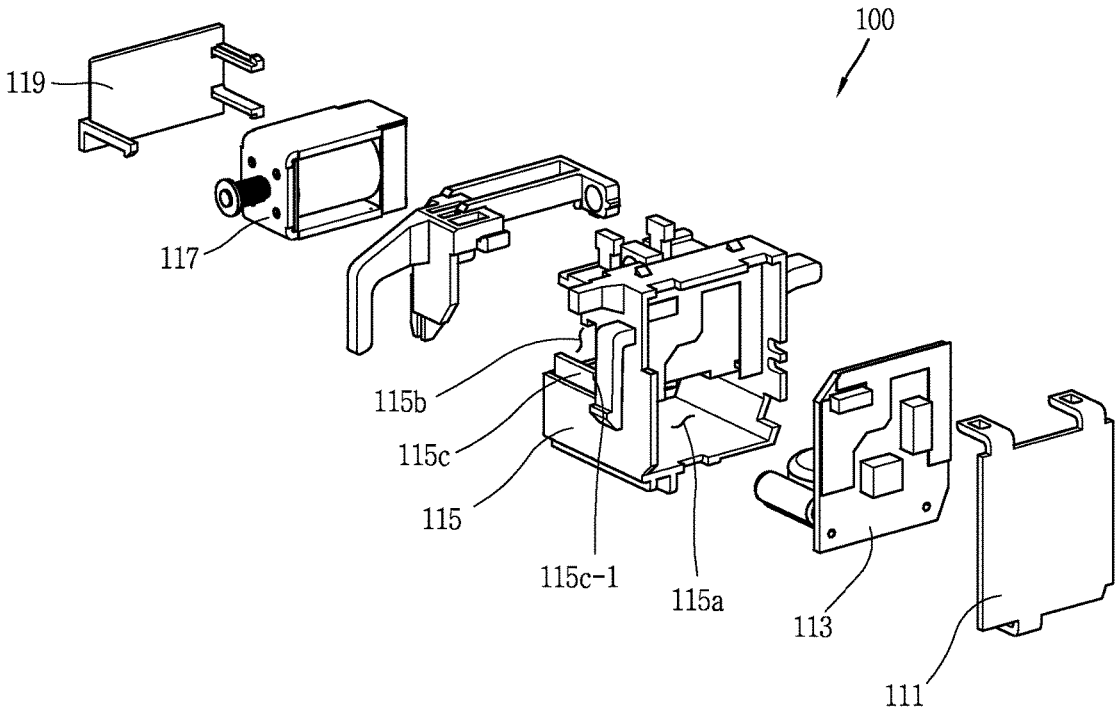
FIG. 8 is an exploded perspective view illustrating a tripping device provided in a circuit breaker according to the present disclosure.
Figure 9:
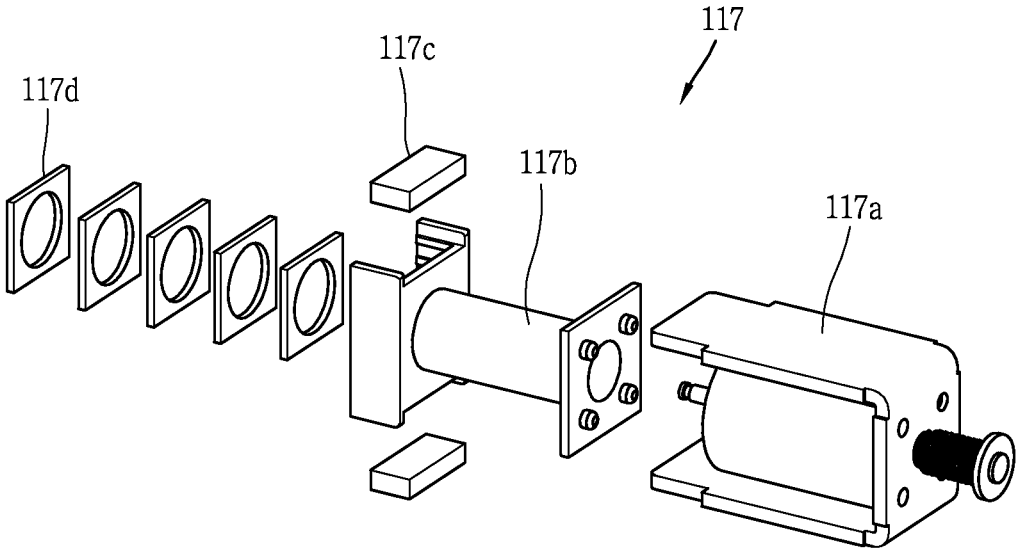
FIG. 9 is an exploded perspective view illustrating an actuator provided in a tripping device according to the present disclosure.
Figure 10A:
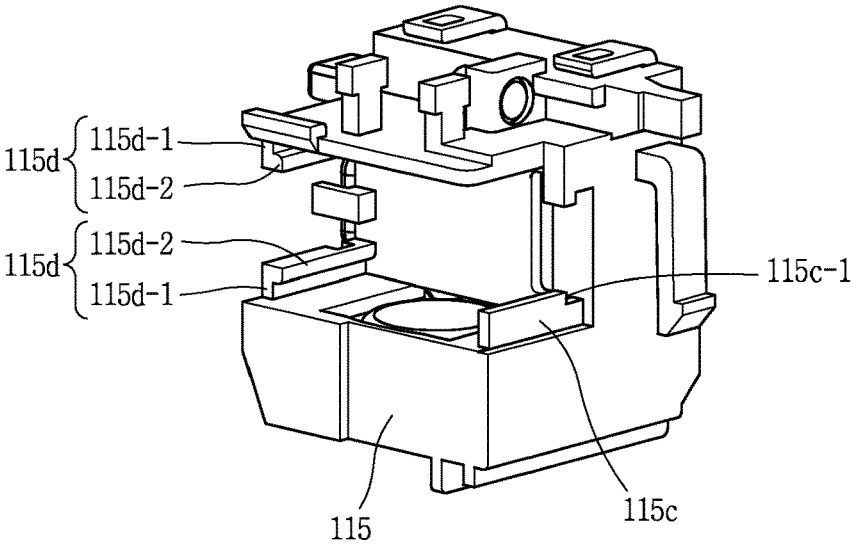
FIG. 10A is a perspective view illustrating a housing constituting a tripping device according to the present disclosure.
Figure 10B:
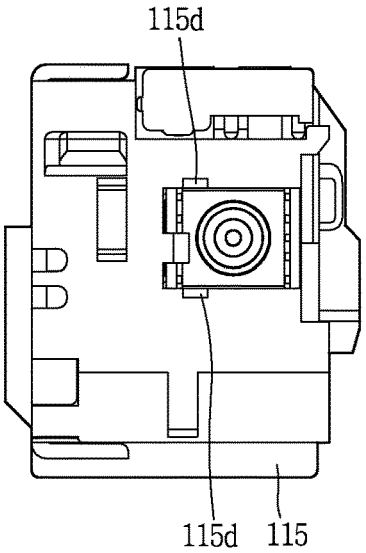
FIG. 10B is a front view illustrating a housing constituting a tripping device according to the present disclosure.
Figure 11A:
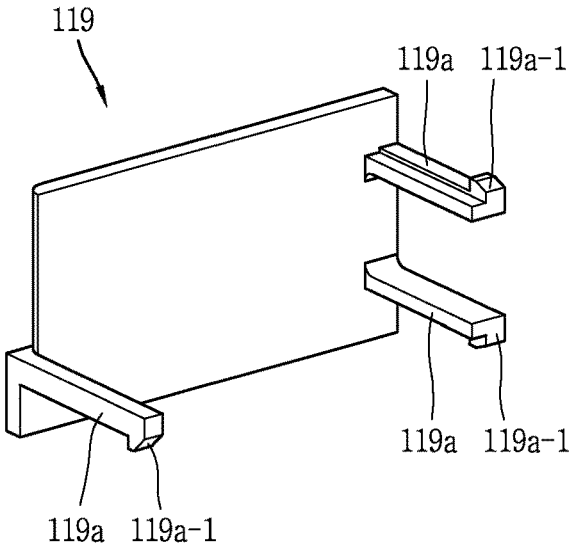
FIG. 11A is a perspective view illustrating a first cover constituting a tripping device according to the present disclosure.
Figure 11B:
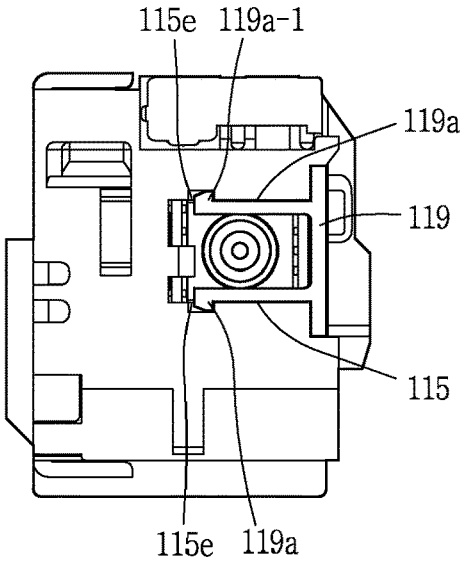
FIG. 11B is a front view illustrating a configuration in which the first cover is coupled to a tripping device according to the present disclosure.

FIG. 7 is a perspective view illustrating a circuit breaker according to the present disclosure, and FIG. 8 is an exploded perspective view illustrating a tripping device provided in a circuit breaker according to the present disclosure, and FIG. 9 is an exploded perspective view illustrating an actuator provided in a tripping device according to the present disclosure;

Furthermore, FIG. 10A is a perspective view illustrating a housing constituting a tripping device according to the present disclosure, and FIG. 10B is a front view illustrating a housing constituting a tripping device according to the present disclosure, and FIG. 11A is a perspective view illustrating a first cover constituting a tripping device according to the present disclosure, and FIG. 11B is a front view illustrating a configuration in which the first cover is coupled to a tripping device according to the present disclosure.

Figure 12:
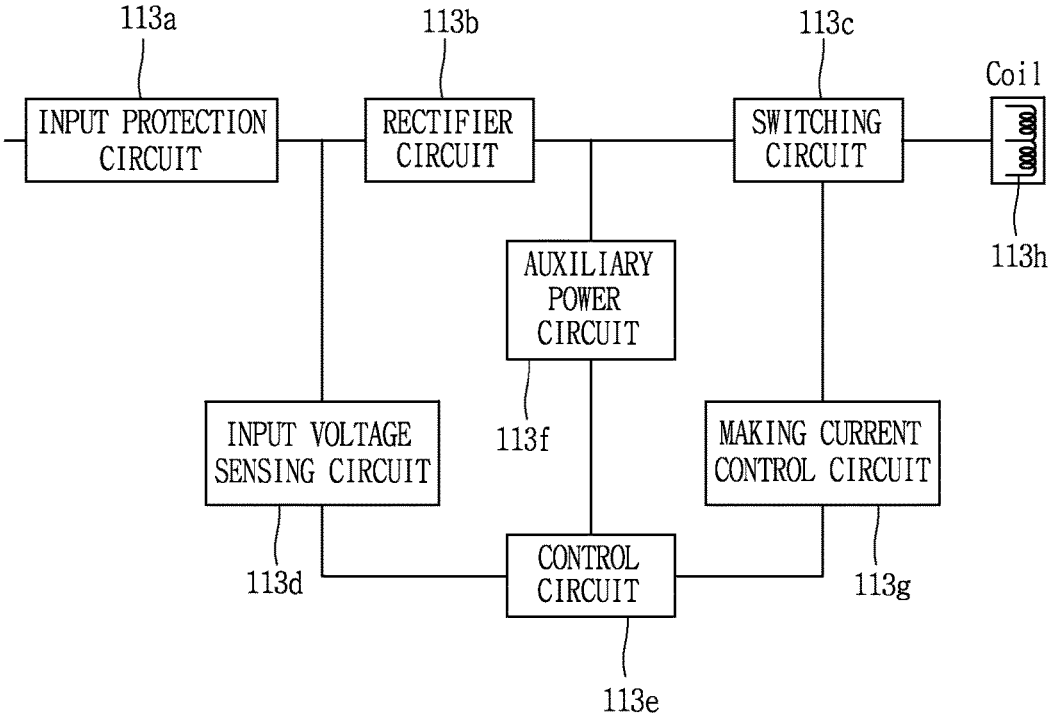
FIG. 12 is a block diagram illustrating a control circuit unit used for a circuit breaker according to the present disclosure.
Figure 13:
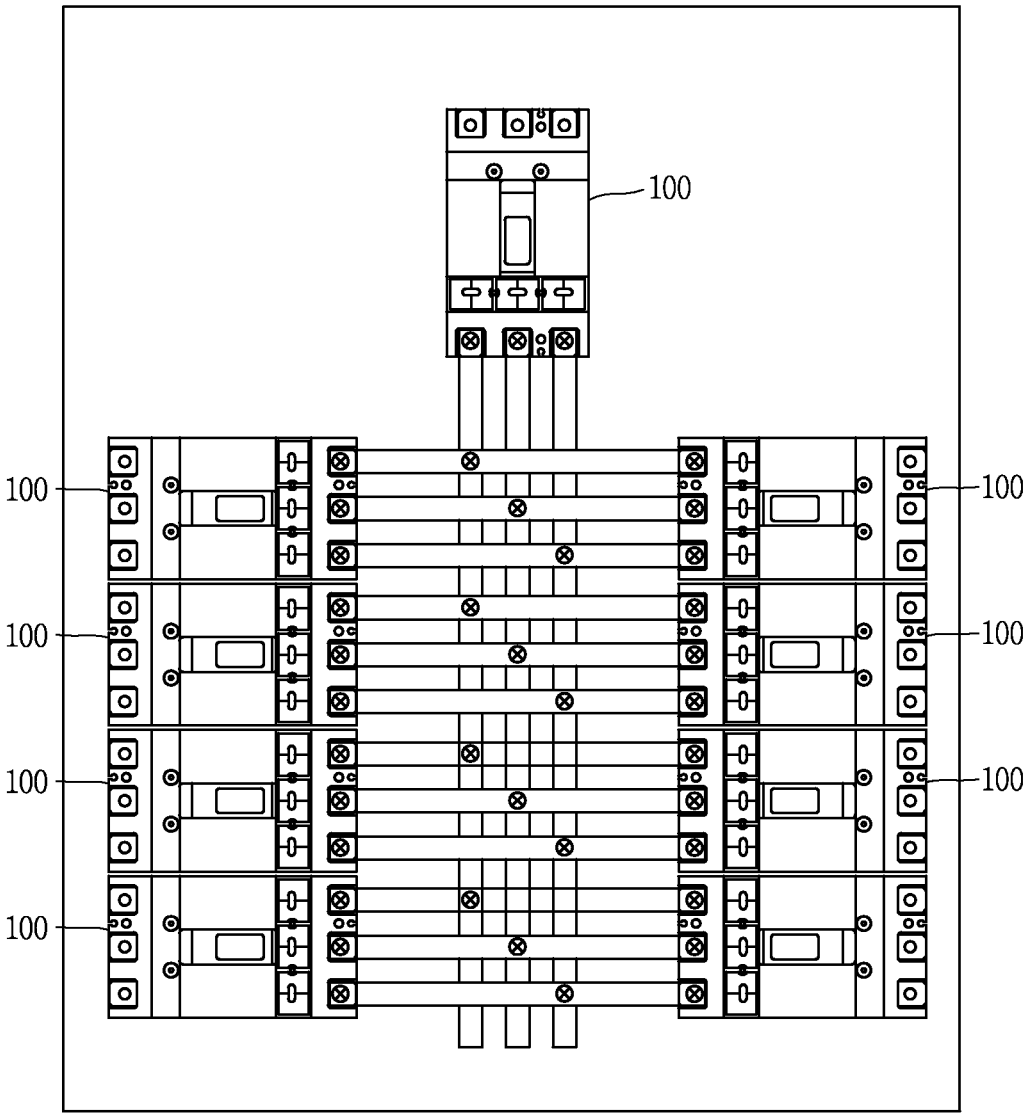
FIG. 13 is a plan view illustrating a configuration in which a plurality of circuit breakers according to the present disclosure are installed on a distribution board.
Figure 14A:
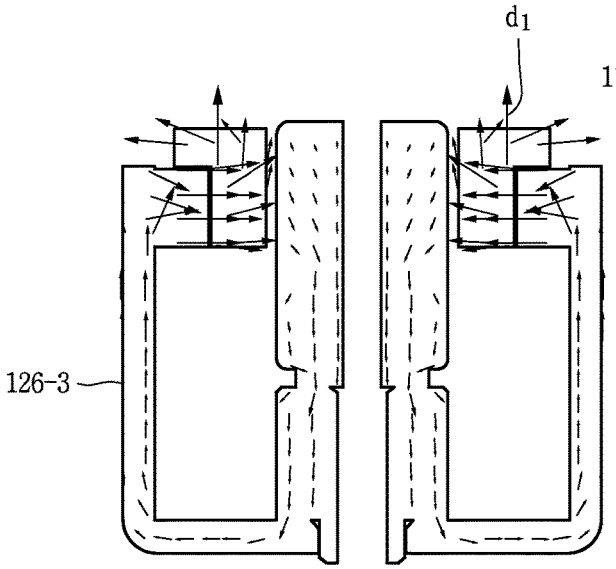
FIG. 14A is a schematic view illustrating a magnetic flux direction of an actuator used for a circuit breaker in the related art.
Figure 14B:
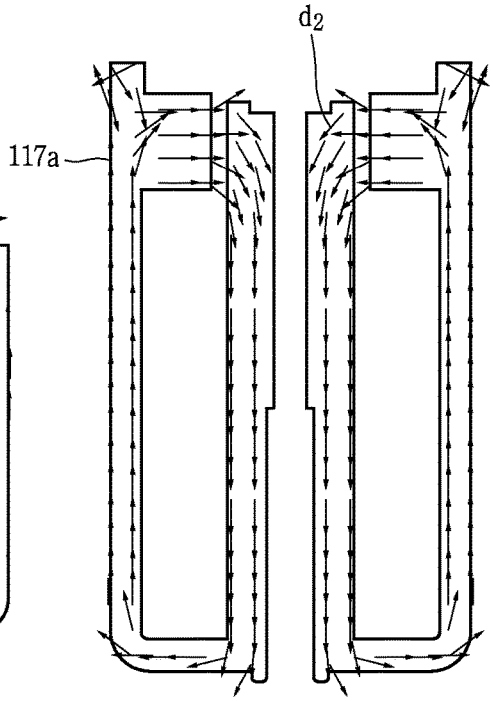
FIG. 14B is a schematic view illustrating a magnetic flux direction of an actuator used for a circuit breaker according to the present disclosure.

Furthermore, FIG. 12 is a block diagram illustrating a control circuit unit used for a circuit breaker according to the present disclosure, and FIG. 13 is a plan view illustrating a configuration in which a plurality of circuit breakers according to the present disclosure are installed on a distribution board, and FIG. 14A is a schematic view illustrating a magnetic flux direction of an actuator used for a circuit breaker in the related art, and FIG. 14B is a schematic view illustrating a magnetic flux direction of an actuator used for a circuit breaker according to the present disclosure.

As illustrated in FIGS. 7 through 9, a tripping device 110 of a circuit breaker according to the present disclosure receives control power from a control circuit unit 113 to allow a stationary contact point (not shown) and a movable contact point (not shown) to be brought into contact with or separated from each other so as to control power supply to a load.

Here, the tripping device 110 may include a housing 115, a first cover 119 coupled to one side of the housing 115, an actuator 117 provided at an inner portion of the housing 115, a control circuit unit 113 provided at an inner portion of the housing 115, and a second cover 111 coupled to the other side of the housing 115.

An opening portion 115*a* configured to be open to insert the control circuit unit 113 therein is formed at one side of the housing 115, and a mounting space 115*b* fixed in a state that the actuator 117 is mounted thereon is formed at the other side of the housing 115, and thus the control circuit unit 113 and the actuator 117 are provided at an inner portion of the housing 115.

The actuator 117 is mounted on the mounting space 115*b* to receive control power from the control circuit unit 113 to allow the movable core and the stationary core to be brought into contact with or separated from each other.

Here, the actuator 117 may include a yoke portion 117*a*, a bobbin 117*b*, a permanent magnet 117*c*, and a magnetic force reinforcing plate 117*d*.

The yoke portion 117*a* receives control power from the control circuit unit 113 to form a main magnetic flux path, and is formed to surround the bobbin 117*b*, the permanent magnet 117*c*, and the magnetic force reinforcing plate 117*d*.

The bobbin 117*b* is wound with a coil (not shown), and the permanent magnets 117*c* for reinforcing a magnetic force are attached to both sides thereof, and the stationary core and movable core are brought into contact with or separated from each other while moving by a magnetic force generated through the coil therein.

A plurality of magnetic force reinforcing plates 117*d* are sequentially located in an adhering manner to reinforce a magnetic force formed on the main magnetic flux path through the yoke portion 117*a*.

Here, the number of the magnetic force reinforcing plates 117*d* may be controlled to control a retaining force of the stationary core and the movable core (a force for maintaining the stationary core and the movable core in a mutual contact state).

Accordingly, when the number of magnetic force reinforcing plates 117*d* is controlled to increase a retaining force of the stationary core and the movable core, an elastic member (not shown) may provide a restoring force in a direction opposite to the retaining force, and thus the elastic member providing a larger restoring force when the stationary core is separated from the movable core may be used, thereby quickly implementing a trip operation when the stationary core is separated from the movable core.

Furthermore, as illustrated in FIG. 14, since the plate yoke 17*b*-7 is used in case of the related art, a magnetic flux is divided into the yoke portion 12*b*-1 and the plate yoke 12*b*-7 (d1), but since the plate yoke 12*b*-7 is not used in case of the present disclosure, the magnetic flux is formed only on the yoke portion 117*a* (d2), thereby greatly enhancing a retaining force of the stationary core and the movable core.

On the other hand, the control circuit unit 113 is provided along with the actuator 117 at an inner portion of the housing 115 to supply control power to the actuator 117, thereby allowing the stationary core and the movable core to be brought into contact with or separated from each other.

As illustrated in FIG. 12, the control circuit unit 113 may include an input protection circuit 113*a*, a rectifier circuit 113*b*, a switching circuit 113*c*, an input voltage sensing circuit 113*d*, a control circuit 113*e*, a making current control circuit 113*g*, and an auxiliary power circuit 113*f*.

Accordingly, when power is applied in a state that the control circuit unit 113 is provided at an inner portion of the housing 115, the actuator 117 is activated through the process of applying power to the auxiliary power circuit 113*f* through the input protection circuit 113*a* and the rectifier circuit 113*b*, and turning on the switching circuit to flow a current through a coil 113*h*.

As illustrated in FIG. 13, a plurality of circuit breakers 100 according to the present disclosure are connected and used at an inner portion of the distribution board in a state that the control circuit unit 113 is installed therein.

In case of the present disclosure, a magnetic force on the main magnetic flux path may be reinforced using a plurality of magnetic force reinforcing plates 117*d* without using an additional plate yoke 12*b*-7 on the actuator 117 provided in the circuit breaker 100 to miniaturize the size of the actuator 117, and thus the control circuit unit 113 provided at an outer portion of the circuit breaker 100 may be installed at an inner portion of the circuit breaker 100, thereby miniaturizing the whole size of the circuit breaker 100.

Furthermore, since the whole size of the circuit breaker 100 is miniaturized, the number of circuit breakers 100 that can be installed on a distribution board may be increased, thereby efficiently implementing the control of a current through the distribution board.

On the other hand, as illustrated in FIGS. 11A and 11B, the first cover 119 may be inserted into the other side of the housing 115 to prevent the actuator 117 from being exposed to the outside as well as support the actuator 117 to the housing 115 not to be released in a state that the actuator 117 is fixed to the housing 115.

A first support fixture 119*a* is formed at one side of the first cover 119 such that the first support fixture 119*a* is adhered to the magnetic force reinforcing plate 117*d* to maintain a state that the magnetic force reinforcing plate 117*d* is adhered to the bobbin 117*b*.

Here, one or a plurality of first support fixtures 119*a* may be formed therein, and a ring-shaped first support fixture engaging ring 119*a*-1 is formed at one end of the first support fixture 119*a*, and an engaging ring insertion groove 115*e* is formed at a position corresponding to the first support fixture engaging ring 119*a*-1 on the housing 115.

Accordingly, when the first cover 119 is inserted into the other side of the housing 115, the first support fixture 119*a* may be adhered to the magnetic force reinforcing plate 117*d* while at the same time the first support fixture engaging ring

119*a*-1 is inserted into the engaging ring insertion groove 115*e*, thereby preventing the magnetic force reinforcing plate 117*d* from being released to the outside through the first cover 119.

A second support fixture 119*b* supporting the actuator 117 in a front direction of the actuator 117 is formed at the other side of the first cover 119, and a second support fixture engaging ring 119*b*-1 is formed at an end of the second support fixture 119*b*.

Furthermore, an adhesion plate 115*c* is formed on the housing 115 to be adhered to a lower surface of the second support fixture 119*b*, and an engaging groove 115*c*-1 is formed at an upper portion of the adhesion plate 115*c*.

Accordingly, when the first cover 119 is inserted into the housing 115, the first cover 119 may be coupled to the housing 115 while a lower surface of the second support fixture 119*b* is adhered to the adhesion plate 115*c* and at the same time the second support fixture engaging ring 119*b*-1 is engaged with the engaging groove 115*c*-1.

The second cover 111 is detachably adhered to one side of the housing 115 to close the opening portion 115*a*, thereby preventing the control circuit unit 113 from being exposed to the outside.

In case of the present disclosure, the first support fixture 119*a* and second support fixture 119*b* are installed on the first cover 119, thereby securely supporting the actuator 117 at an inner portion of the housing 115 as well as preventing the magnetic force reinforcing plate 117*d* provided on the actuator 117 from being released from a fixed position.

Furthermore, the first support fixture engaging ring 119*a*-1 and the second support fixture engaging ring 119*b*-1 may be formed on the first support fixture 119*a* and the second support fixture 119*b*, thereby securely coupling the first cover 119 to the housing 115.

On the other hand, as illustrated in FIGS. 10A and 10B, a release prevention member 115*d* located to be vertically spaced by a predetermined distance to prevent the permanent magnet 117*c* from being released is further formed adjacent to the mounting space 115*b* of the housing 115.

Here, the release prevention member 115*d* may include a vertical plate 115*d*-1 and a support plate 115*d*-2.

The vertical plate 115*d*-1 is formed in a vertical direction at an inner portion of the housing 115 to support the permanent magnet 117*c* on a lateral surface thereof.

The support plate 115*d*-2 is extended in a horizontal direction from one end of the vertical plate 115*d*-1 to support the permanent magnet 117*c* on an upper or lower portion thereof.

In case of the present disclosure, the permanent magnet 117*c* of the actuator 117 coupled to the housing 115 through the release prevention member 115*d* may be securely fixed to an inner portion of the housing 115, thereby preventing the permanent magnet 117*c* from easily released from the inner portion of the housing 115 to the outside.

While the present invention has been described in terms of its preferred embodiments, various alternatives, modifications and equivalents will be apparent to those skilled in the art, and it is clear that the invention is applicable in the same manner by appropriately modifying the above embodiments. Accordingly, the disclosure is not intended to limit the scope of the invention as defined by the limitation of the following claims.

What is claimed is:

1. A tripping device of a circuit breaker for receiving control power from a control circuit unit to allow a stationary contact point and a movable contact point to be brought into contact with or separated from each other to control power supply to a load, the tripping device comprising:

a housing formed with a mounting space to which an actuator is mounted and fixed at one side thereof;

the actuator mounted and fixed to the mounting space, and configured with a yoke portion configured to receive control power from the control circuit unit to form a main magnetic flux path, a bobbin wound with a coil and attached to a permanent magnet, and a magnetic force reinforcing plate adhered to the bobbin to reinforce a magnetic force formed on the main magnetic flux path;

a first cover formed with a first support fixture inserted into the other side of the housing, and adhered to the magnetic force reinforcing plate at one side thereof to maintain a state that the magnetic force reinforcing plate is adhered to the bobbin; and a second cover formed with an opening portion configured to be opened to insert the control circuit unit therein at the other side of the housing, and detachably adhered to the other side of the housing to close the opening portion to prevent the control circuit unit from being exposed to the outside.

2. The tripping device of claim 1, wherein a first support fixture engaging ring is formed at one end of the first support fixture, and an engaging ring insertion groove is formed at a position corresponding to the first support fixture engaging ring on the housing to adhere the first support fixture to the magnetic force control plate while at the same time the first support fixture engaging ring is inserted into the engaging ring insertion groove when the first cover is inserted into the other side of the housing.

3. The tripping device of claim 1, wherein a second support fixture supporting the actuator in a front direction of the actuator is formed at the other side of the first cover, and a second support fixture engaging ring is formed at an end of the second support fixture, and an adhesion plate is formed on the housing to be adhered to a lower surface of the second support fixture, and an engaging groove is formed at an upper portion of the adhesion plate, and when the first cover is inserted into the housing, the second support fixture engaging ring is inserted into the engaging groove while at the same time a lower surface of the second support fixture is adhered to the adhesion plate.

4. The tripping device of claim 1, wherein a release prevention member located to be vertically spaced by a predetermined distance to prevent the permanent magnet from being released is further formed adjacent to the mounting space of the housing.

5. The tripping device of claim 4, wherein the release prevention member comprises a vertical plate formed in a vertical direction to support the permanent magnet on a lateral surface thereof, and a support plate extended in a horizontal direction from one end of the vertical plate to support the permanent magnet on an upper or lower portion thereof.

* * * * *